US005540559A

United States Patent [19]

Kimura et al.

[11] Patent Number: 5,540,559

[45] Date of Patent: Jul. 30, 1996

[54] VARIABLE CAPACITY SWASH-PLATE TYPE COMPRESSOR

[75] Inventors: Kazuya Kimura; Hiroaki Kayukawa, both of Kariya, Japan

[73] Assignee: Ube Industries, Ltd., Yamaguchi, Japan

[21] Appl. No.: 224,272

[22] Filed: Apr. 7, 1994

[30] Foreign Application Priority Data

Apr. 8, 1993 [JP] Japan ..... 5-081944

[51] Int. Cl.[6] ..... F04B 1/29

[52] U.S. Cl. ..... 417/222.2; 74/60; 92/12.2

[58] Field of Search ..... 417/222.1, 222.2, 417/269, 270; 91/499, 504, 505; 74/60; 92/12.2

[56] References Cited

U.S. PATENT DOCUMENTS

| | | | |
|---|---|---|---|
| 4,073,603 | 2/1978 | Abendschein et al. | 417/222 |
| 4,178,135 | 12/1979 | Roberts | 417/222.2 |
| 4,884,952 | 12/1989 | Kanamaru et al. | 417/222.2 |
| 5,174,728 | 12/1992 | Kimura et al. | 417/222.2 |
| 5,181,453 | 1/1993 | Kayukawa et al. | 92/12.2 |
| 5,228,841 | 7/1993 | Kimura et al. | 417/222.2 |
| 5,293,810 | 3/1994 | Kimura et al. | 91/505 |
| 5,304,042 | 4/1994 | Kayukawa et al. | 74/60 |
| 5,316,446 | 5/1994 | Kimura | 74/60 |
| 5,336,056 | 8/1994 | Kimura et al. | 417/222.1 |
| 5,382,139 | 1/1995 | Kawaguchi et al. | 91/499 |
| 5,387,091 | 2/1995 | Kawaguchi et al. | 417/222.2 |
| 5,417,552 | 5/1995 | Kayukawa et al. | 417/222.2 |

FOREIGN PATENT DOCUMENTS

| | | |
|---|---|---|
| 5296407 | 2/1976 | Japan . |
| 1114988 | 2/1989 | Japan . |
| 4295185 | 10/1992 | Japan . |

*Primary Examiner*—Peter Korytnyk
*Attorney, Agent, or Firm*—Burgess, Ryan and Wayne

[57] ABSTRACT

A variable capacity swash plate type compressor having a hinge unit having a support arm protruding from a back side of a rotor, and a guide pin having one end thereof fixed onto a rotatable swash plate. The support arm has guide holes or guide surfaces which are parallel with a plane passing through a central axis "O" of a drive shaft and the top dead center position of the swash plate, the holes extending in a direction in which the holes approach the drive shaft from the outer edge of the rotor. Sections taken so as to be perpendicular to the center lines of the holes (guide surfaces) can be circular. A spherical element interacting with the guide holes is arranged at the end of the guide pin away from the rotatable swash plate. Thus, the spherical element of the guide pin interacts with the guide holes so that the suction force, compressive reaction force and torque are sustained on a line.

11 Claims, 12 Drawing Sheets

VARIABLE CAPACITY SWASH-PLATE TYPE COMPRESSOR

BACKGROUND OF THE INVENTION

1. Field of the Invention

The present invention relates to a variable capacity swash-plate type compressor adapted for use in a climate control apparatus for a vehicle. More particularly, the present invention relates to an improved hinge unit for pivotally supporting a swash plate of the variable capacity swash-plate type compressor.

2. Description of the Related Art

Conventional variable capacity swash-plate type compressor are disclosed in Japanese Unexamined Patent Publication (Kokai) No. 52-96407 and Japanese Unexamined Utility Model Publication (Kokai)No. 1-114988. For example, the latter compressor is provided with a hinge unit shown in FIG. 14 (Prior Art), in which a rotor 91 is fixed to a drive shaft 90 disposed in a crank chamber, and a long hole 91*a* is formed in the rotor 91. As best shown in FIG. 15 (Prior Art), the long hole 91*a* of the rotor 91 is parallel with a plane determined by the central axis "O" of the drive shaft 90, and the top dead center of a rotary swash plate 93, and the long hole 91*a* a extends toward the central axis "O" of the drive shaft 90 from the outside so that an inner end of the long hole 91*a* is located adjacent to the central axis "O" of the drive shaft. The opposite ends of a section of the long hole 91 a taken perpendicularly to the center line "S" thereof extends linearly so as to be parallel with a plane perpendicular to the axis of rotation of the drive shaft 90. A connecting pin 92 is slidably inserted into the long hole 91*a* of rotor 91, and has an outer end thereof connected with the rotary swash plate 93 via a bracket 93*a* of the rotary swash plate 93, so that the rotary swash plate 93 can be inclined back and forth. A non-rotating wobble plate (not shown) is slidably mounted on the rotary swash plate 93, and a piston rod is provided between the wobble plate and each piston accommodated in each of a plurality of cylinder bores formed in a cylinder block of the compressor.

In the described conventional compressor, the rotation of the drive shaft 90 is converted into the rotation of the rotary swash plate 93 and the nutating motion of the wobble plate by the action of the hinge unit "K". The nutating motion of the wobble plate is converted into the reciprocating motion of each piston in this case, pressure in the crank chamber is controlled by a control valve (not shown in the drawing). Therefore, the inclination angle of the wobble plate is changed, so that the stroke of each piston is also changed. Accordingly, the discharge capacity of the compressor is changed. At this time, the back and forth tilting motion of the rotary swash plate 93 and the nutating motion of the wobble plate are restricted by the long hole 91 a having a predetermined radius of curvature. Accordingly, although the inclination angle of the rotary swash plate 93 is changed, the top dead center of the wobble plate is unchanged in the back and forth direction, resulting in that top clearance of each piston in the corresponding cylinder bore becomes approximately zero at the top dead center of the piston.

However, in the above described type of compressor, since a suction force acts on the piston during the suction stroke thereof, the suction force also acted on the rotary swash plate 93 in a region from the top dead center to the trailing side thereof with respect to the direction of rotation of the drive shaft 90 (i.e., an approximately right half portion of the swash plate 93 in FIG. 14). On the other hand, since a compression-reaction force acts on the piston during the compression stroke thereof, the compression-reaction force also acts on the rotary swash plate 93 in a region thereof extending from the top dead center to the preceding side with respect to a direction of rotation of the drive shaft 90, i.e., approximately a left half portion of the swash plate 93 of FIG. 14. To this end, in the above-described compressor, the trailing side of the swash plate 93 with respect to the direction of rotation of the drive shaft 90 is separated away from the rotor 91, and the preceding side of the swash plate 93 with respect to the direction of rotation of the drive shaft 90 is pressed against the rotor 91.

In the compressors disclosed in the Unexamined Utility Model Publication (Kokai) No. 1-114988, the rotary swash plate 93 is mounted on the drive shaft 90 via a cylindrical sleeve (not shown in FIGS. 14 and 15), and the cylindrical sleeve supports the rotary swash plate 93 via trunnion pins so as to slide in a direction parallel with the central axis "O" of the drive shaft 90 and to nutate back and forth. Accordingly, the rotary swash plate 93 is prevented from conducting uncontrolled twisting motion in a direction different from the nutating direction with respect to the rotor 91 even when the suction force and compression-reaction force act on the rotary swash plate 93.

Nevertheless, in order to permit the rotary swash plate 93 to smoothly perform the nutating motion back and forth, a small gap must be provided between the cylindrical sleeve and the drive shaft 90. Thus, the rotary swash plate 93 is slightly twisted by the above-described suction and compression-reaction forces in a direction different from the back and forth direction with respect to the rotor 91 (for example, the rotary swash plate 93 is twisted by an angle "α", and the connecting pin 92 comes into contact with the long hole 91 a in a point contact condition at a point "I" in FIGS. 14 and 15. Therefore, the suction and compression-reaction forces are concentrically received at the point "I".

Further, when an input torque is exerted by the drive shaft 90, the torque is transmitted from the rotor 91 to the rotary swash plate 93 via the hinge unit "K". Therefore, when the rotary swash plate 93 is constantly twisted by a small angle in the direction different from the exact back and forth direction with respect to the rotor 91, the torque must be concentrically sustained at the point I. Accordingly, in the conventional compressor, the hinge unit "K" provided for regulating the back and forth tilting motion of the swash plate 93 is subjected to an abnormal abrasion during the high speed operation thereof and during the high compression ratio operation thereof.

Similar problems are encountered in a case where, from the viewpoint of easy manufacture of the internal mechanism of the compressor, a sleeve element having a spherical supporting surface is slidably mounted on a drive shaft so as to support a back and forth nutating motion and a rotating motion of the rotary swash plate, respectively, and a pair of equal hinge units are disposed at positions on both sides of the top dead center of the rotary swash plate.

SUMMARY OF THE INVENTION

An object of the present invention is, therefore, to provide a variable capacity swash plate type compressor provided with a hinge unit or units by which the above-mentioned problems encountered by the conventional variable capacity swash plate type compressor can be eliminated.

Another object of the present invention is to provide a novel hinge unit adapted for being incorporated into a variable capacity swash plate type compressor to regulate a back and forth inclining motion of the swash plate without occurrence of abnormal abrasion of the hinge unit even when the swash plate is displaced to a twisted position with respect to the rotor rotating with the drive shaft of the compressor.

In accordance with the present invention, there is provided a variable capacity swash plate type compressor, which comprises: a housing unit defining therein a crank chamber, a suction chamber, a discharge chamber, and a plurality of cylinder bores fluidly communicated with the suction, discharge and crank chambers; pistons provided in each of the cylinder bores, the pistons being capable of reciprocating in the cylinder bores; a drive shaft rotatably supported by the housing unit; a rotor arranged in the crank chamber, and mounted on the drive shaft so as to be rotated together with the drive shaft; a swash plate connected with the rotor via a hinge unit, the swash plate being also connected with the drive shaft via a sleeve to thereby be able to change an inclination angle thereof; and a connection unit arranged between the swash plate and pistons, the connection unit converting a rotating motion of the swash plate into a reciprocating motion of the pistons, wherein the inclination angle of the swash plate is controlled by a pressure in the crank chamber to thereby change the discharge capacity of the compressor, wherein the hinge unit includes at least one support arm protruding backward from the rotor, and a guide pin, one end of which is fixed onto the swash plate, wherein the support arm has a guide surface which is parallel with a surface determined by a central axis of the drive shaft and a top dead center position of the swash plate, the guide surface extends in a direction in which the guide surface approaches the shaft center of the drive shaft from the outside, the guide surface is formed so that at least a rotor side of a section of guide surface taken perpendicularly to a center line of the guide surface is formed into a circular arc, and the other end of the guide pin being provided with a spherical element engaged with the guide surface.

In the above-described compressor, the guide surface of the support arm is defined by a wall of a circular hole formed in the support arm, and the spherical element is fixed to the other end of the guide pin, and is rotatably and slidably in contact with and guided by the guide surface of the support arm.

in the above-described compressor, the spherical element is held by the other end of the guide pin so as to be free to rotate, and the spherical element being fitted in the guide surface so as to roll on the guide surface.

In accordance with another aspect of the present invention, there is provide a variable capacity swash plate type compressor comprising: a housing unit in which a crank chamber, a suction chamber, a discharge chamber and a plurality of cylinder bores fluidly communicated with the chambers are formed; pistons arranged in each of the cylinder bores, the pistons being capable of reciprocating in the respective cylinder bores; a drive shaft rotatably supported by the housing unit; a rotor arranged in the crank chamber, the rotor being supported by the drive shaft in a manner such that the rotor rotates in synchronism with the drive shaft; a swash plate connected with the rotor via a hinge unit, the swash plate being also connected with the drive shaft via a sleeve, whereby an inclination angle of the swash plate can be changed; and a connection unit arranged between the swash plate and pistons, the connection unit converting a nutating motion of the swash plate into a reciprocating motion of the pistons, wherein the inclination angle of the swash plate is controlled by a pressure in the crank chamber so that the discharge capacity of the compressor is changed, and wherein the hinge unit includes at least one support arm protruding backward from the rotor, and a guide pin having one end thereof fixed onto the swash plate, wherein the support arm has a guide surface arranged so as to be parallel with a surface determined by a central axis of the drive shaft and a top dead center position of the swash plate, the guide surface extending in a direction in which the guide surface approaches the central axis of the drive shaft from the outside, the guide surface being defined by a wall of a circular or square hole, the other end of the guide pin is provided with a spherical element, a shoe being rotatably held by the spherical element, and slidably fitted in the guide surface of the support arm.

In the described variable capacity swash-plate type compressor, the hinge unit may be arranged on both sides of the top dead center of the swash plate.

In the described variable capacity swash-plate type compressor, the guide surface of the compressor preferably has a radius of curvature by which the top dead center of the respective pistons may be maintained minimum irrespective of the inclination angle of the swash plate.

In the compressor according to the present invention, at least a rotor side of a section of the guide surface taken perpendicularly to the center line of the guide surface is formed into a cylindrical arc, and this guide surface is engaged with the spherical element of the guide pin. Accordingly, for example, even where the swash plate is twisted around an axis perpendicular to the axis of the drive shaft with respect to the rotor, the spherical element of the guide pin is in line contact with the guide surface. Therefore, the suction and compression-reaction forces and torque are supported by the line contact portion of the spherical element and the guide surface.

BRIEF DESCRIPTION OF THE DRAWINGS

The above and other objects, features, and advantages of the present invention will be made more apparent from the ensuing description of the preferred embodiments with reference to the accompanying drawings wherein.

DESCRIPTION OF THE PREFERRED EMBODIMENTS

Figure 1:
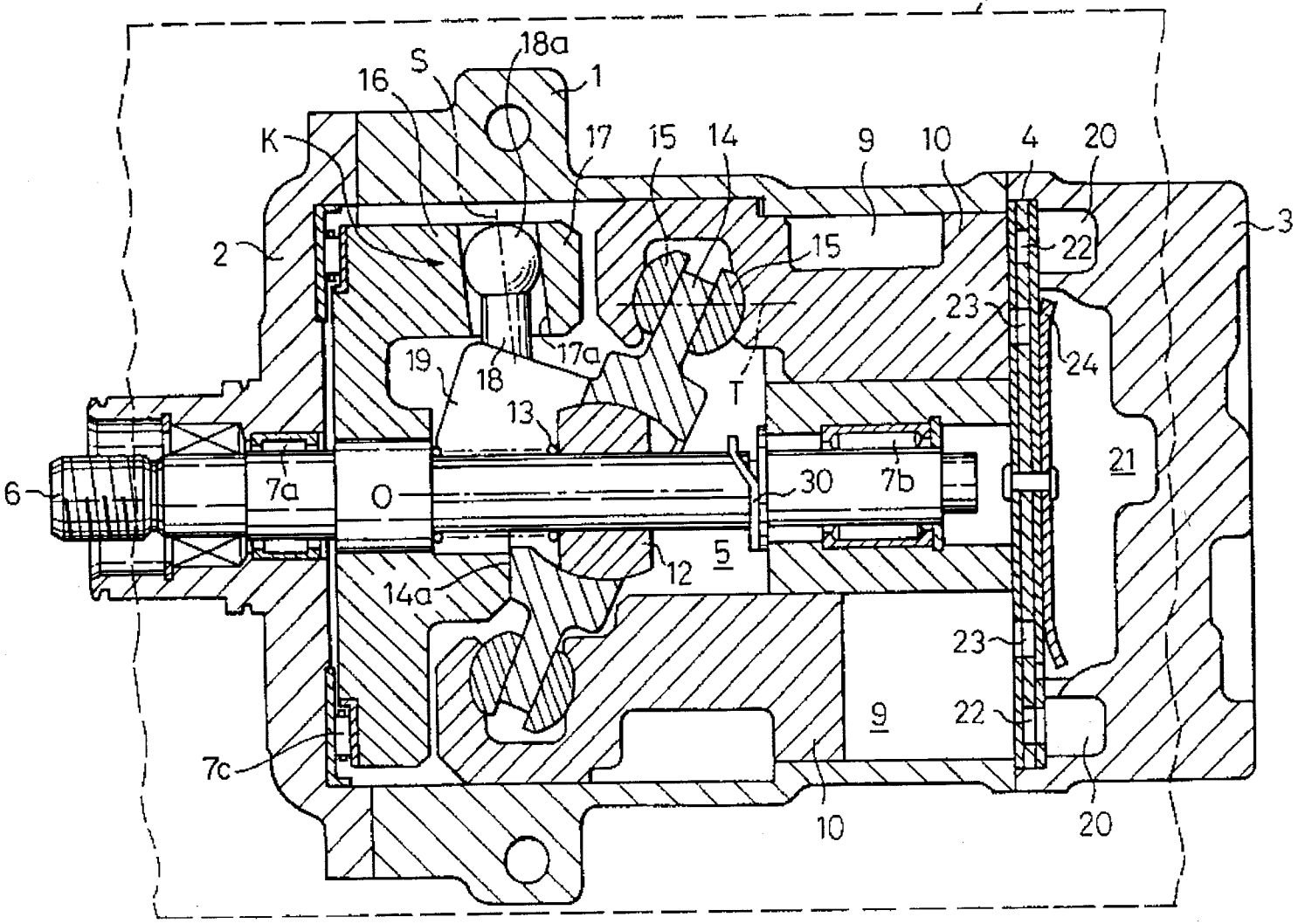
FIG. 1 is a longitudinal sectional view of variable capacity swash plate type compressor according to an embodiment of the present invention, illustrating the maximum capacity position thereof.
Figure 2:
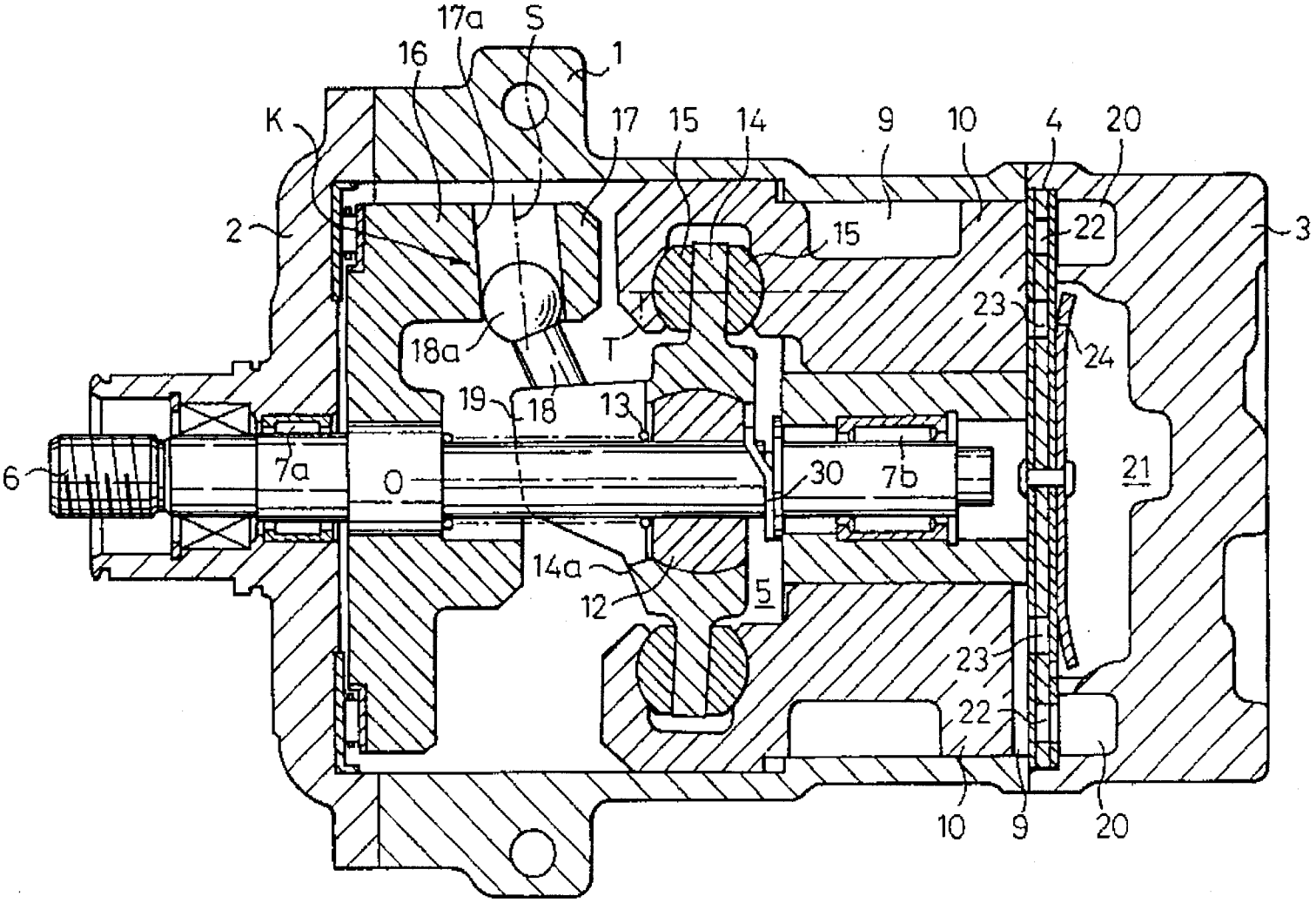
FIG. 2 is a longitudinal sectional view of the compressor of FIG. 1, illustrating the minimum capacity position thereof.

Referring to FIGS. 1 and 2, the compressor has a front housing 2 which is joined to one side of a cylinder block 1, and a rear housing 3 joined to the other side of the cylinder block 1 through a valve plate 4. A drive shaft 6 is provided in a crank chamber 5 formed by the cylinder block 1 and front housing 2. The drive shaft 6 is rotatably supported by anti-friction bearings 7*a*, 7*b*. A plurality of cylinder bores 9 are formed in the cylinder block 1 at positions surrounding the drive shaft 6. A piston 10 is respectively inserted into each cylinder bore 9 of the cylinder block 1.

In the crank chamber 5, a rotor 16 is mounted on the drive shaft 6 so as to be rotated together with the drive shaft 6 under the support of a thrust bearing seated 7*c* against an inner end of the front housing 2, and a spherical sleeve 12 having an outer spherical surface formed as a support surface is slidably supported by the drive shaft 6. A compression spring 13 mounted around the drive shaft 6 is interposed between the rotor 16 and the spherical sleeve 12. The compression spring 13 pushes the spherical sleeve 12 in a direction toward the rear housing 3.

Figure 4:
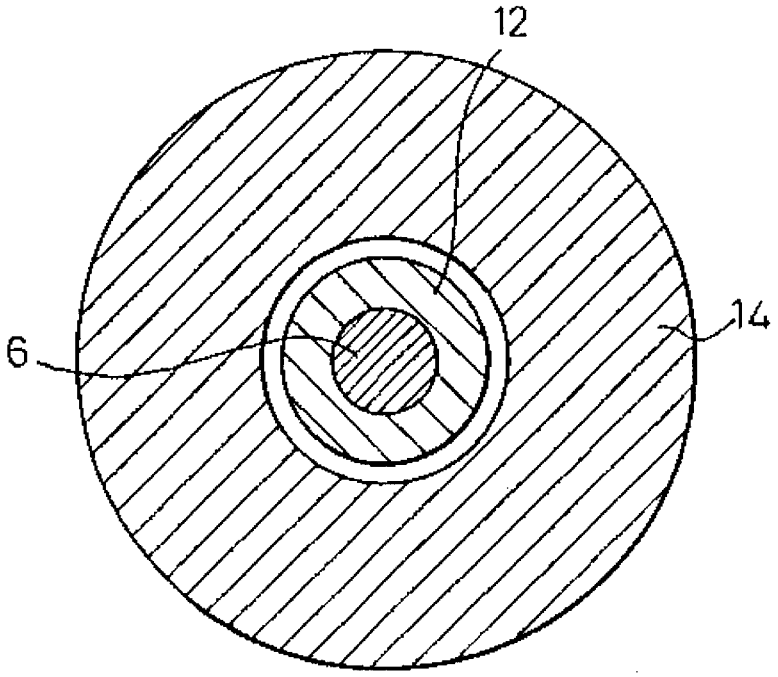
FIG. 4 is a sectional view taken along the line IV—IV of FIG. 3, illustrating the swash plate and spherical sleeve of the compressor of FIG. 1.

As illustrated in FIG. 4, a rotary swash plate 14 is rotatably supported on the outer support surface of the spherical sleeve 12. Under a condition that the compression spring 13 is most compressed as shown in FIG. 1, a contact surface 14*a* formed on a lower back face of the rotary swash plate 14 comes into contact with the rotor 16, and therefore, a further increase of inclination angle of the rotary swash plate 14 is restricted by the rotor. Under a condition that the compression spring 13 is most extended as shown in FIG. 2, the spherical sleeve 12 comes into contact with a stop 30 engaged With the drive shaft 6, and therefore, a further decrease of inclination angle of the rotary swash plate 14 is restricted by the stop 30.

Semispherical shoes 15, 15 come into contact with the outer circumferential portion Of the rotary swash plate 14, and outer circumferential surfaces of these shoes 15, 15 are engaged with a spherical supporting surface of the piston 10. In this way, the plurality of pistons 10 are engaged with the rotary swash plate 14 via the shoes 15, 15. The pistons 10 are slidably accommodated in respective cylinder bores 9 so as to be reciprocated in the cylinder bores 9.

Figure 3:
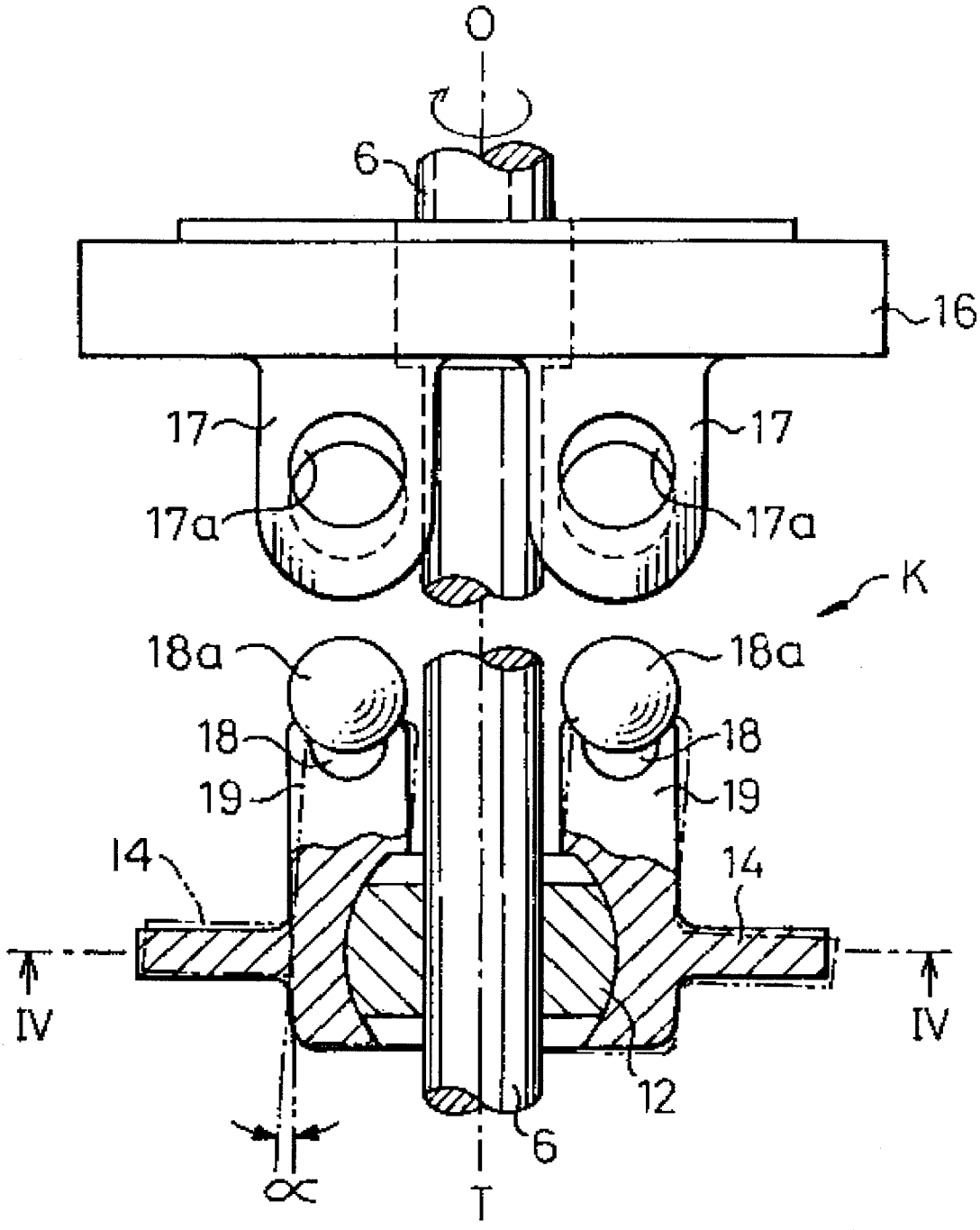
FIG. 3 is a partially sectional exploded plan view of a hinge unit of the compressor of FIG. 1.

As illustrated in FIG. 3, a pair of brackets 19, 19 composing a part of the hinge unit "X" protrude from the back surface of the rotary swash plate 14 and are disposed on both sides of the top dead center "T" of the rotary swash plate 14. The drive shaft 6 is arranged so as to be interposed between the two brackets 19, 19 of the rotary swash plate 14. A guide pin 18 is fixed to each bracket 19 at one end thereof, and the other end of the guide pin 18 is fixed to a spherical element 18*a*.

A pair of support arms 17, 17 composing the remaining part of the hinge unit K protrude from an upper front surface of the rotor 16 in the rear direction of the drive shaft in such a manner that the support arms 17, 17 are opposed to the guide pins 18, 18. A circular guide hole 17*a* is linearly formed in each support arm 17 in parallel with a plane which passes through the central axis "O" of the drive shaft 6 and the top dead center "T" of the rotary swash plate 14 as shown in FIG. 1, in a direction in which the circular hole 17*a* approaches the central axis "O" of the drive shaft 6 from the outer edge of the rotor 16. The direction of the center line "S" of the circular hole 17*a* is determined so that the top dead center of each piston 10 is unchanged in the longitudinal direction of the cylinder bore 9 irrespective of a change in the inclination angle of the rotary swash plate 14. A section of the circular hole 17*a* taken perpendicularly to the center line S of the hole 17*a* is circular. An inner circumferential surface of the circular hole 17*a* works as a guide surface, and the spherical element 18*a* of the guide pin 18 is rotatably and slidably inserted into the circular hole (guide surface) 17*a*.

As illustrated in FIGS. 1 and 2, the inside of the rear housing 3 is divided into suction and discharge chambers 20 and 21. Suction ports 22 and discharge ports 23 are formed in a valve plate 4 so as to positionally correspond to respective cylinder bores 9. A compression chamber formed between the valve plate 4 and the piston 10 is communicated with the suction chamber 20 and the discharge chamber 21 via the suction and discharge ports and 23. Each suction port 22 is covered by a suction valve which opens and closes the suction port 22 in accordance with the reciprocating motion of the piston 10. Each discharge port 23 is covered by a discharge valve which opens and closes the discharge port 23 in accordance with the reciprocating motion of the piston 10 while the opening motion of the discharge valve is restricted by a retainer 24.

The rear housing 3 receives therein a control valve (not shown) which adjustably changes the pressure level in the crank chamber 5.

With the compressor constructed in the above-described manner, when the rotary swash plate 14 is rotated by the drive shaft 6, reciprocation of each piston 10 in the cylinder bore 9 is caused by the swash plate 14, via the shoes 15, 15. Accordingly, refrigerant gas is sucked from the suction chamber 20 into each compression chamber, and the refrigerant gas is compressed and discharged toward the discharge chamber 21. At this time, capacity of the refrigerant gas discharged from the respective cylinder bores 9 into the discharge chamber 21 is controlled by the control valve which adjustably changes the pressure level in the crank chamber 5.

Namely, when the swash plate 14 is moved to the small inclination angle position shown in FIG. 2, and when the pressure level in the crank chamber 5 is lowered by the operation of the control valve, the back pressure acting on each piston 10 is lowered, and therefore, the inclination angle of the rotary swash plate 14 is increased. More specifically, the spherical portion 18*a* of the guide pin 18 in the hinge unit "K" is moved toward the drive shaft in the circular guide hole (guide surface) 17*a*, and at the same time, the spherical element 18*a* is slid in the circular guide hole (guide surface) 17*a* along the center line "S" in such a manner that the spherical element 18*a* is moved away from the inside of the guide hole 17*a*. Also, the rotary swash plate 14 nutates backward around the spherical sleeve 12, and the spherical sleeve 12 is moved toward the front of the compressor forward against the force of the spring 13.

Thus, the inclination angle of the rotary swash plate 14 is increased, and accordingly, the compressor is changed from the condition shown in FIG. 2 to that shown in FIG. 1, and the stroke of the respective pistons 10 is extended and the discharge capacity is increased.

On the other hand, when the pressure level in the crank chamber 5 is raised by the operation of the control valve during the condition shown in FIG. 1, the back pressure acting on the respective pistons 10 is increased, and therefore, the inclination angle of the rotary swash plate 14 is reduced. Namely, the spherical element 18*a* of the guide pin 18 in the hinge unit "K" moves toward the outer edge of the rotor in the circular guide hole (guide surface) 17*a*, and at the same time, the spherical element 18*a* slides in the circular guide hole (guide surface) 17*a* along the center line S in such a manner that the spherical element 18*a* approaches from the outside. Also, the rotary swash plate 14 nutates forward around the spherical sleeve 12, and the spherical sleeve 12 is moved backward yielding to the force of the pushing spring 13. Due to the foregoing, the inclination angle of the rotary swash plate 14 is decreased. Therefore, the condition of the compressor is changed to that shown in FIG. 2, and therefore, the stroke of each piston 10 is reduced so that the discharge capacity is decreased.

In the compressor of FIGS. 1 and 2, a suction force acts on each piston 10 during the suction stroke thereof. Therefore, the suction force acts on the rotary swash plate 14 in a region from the top dead center "T" to the rear side of the drive shaft 6 with respect to the rotational direction (in the right half portion of FIG. 3 ). On the other hand, a compression-reaction force acts on the pistons 10 during the compression stroke thereof. Therefore, a compression-reaction force acts on the rotary swash plate 14 in a region from the top dead center "T" to the front side of the drive shaft 6 with respect to the rotational direction (in the left half portion of FIG. 3). For this reason, the rotary swash plate 14 is separated away from the rotor 16 on the rear side with respect to the rotational direction, and the rotary swash plate 14 is pressed against the rotor 16 on the front side with respect to the rotational direction.

The support arms 17, 17 and guide pins 18, 18 of the compressor of FIGS. 1 and 2 are arranged on both sides with respect to the top dead center "T" of the rotary swash plate 14. Therefore, the suction force and compression-reaction force are respectively supported by the support arms 17, 17 and the guide pins 18, 18 in an appropriate condition, and thus, the rotary swash plate 14 can be prevented from being twisted around an axis perpendicular to the axis "O" with respect to the rotor 16. However, from the viewpoint of easy manufacture of the compressor, the spherical sleeve 12 is employed for providing the swash plate 14 with a stable support during not only the back and forth nutating motion thereof but also the rotational motion thereof.

In order to stably support the rotary swash plate 14 during the back and forth nutating motion thereof, it is necessary to provide a small gap between the circular guide holes (guide surfaces) 17*a*, 17*a* and the spherical elements 18*a*, 18*a* of the guide pins 18, 18. As a result, the rotary swash plate 14 is slightly twisted around an axis perpendicular to the central axis "O" of the drive shaft 6 with respect to the rotor 16, for example, the rotary swash plate 14 is twisted by a small angle "α" as shown in FIG. 3. In the case shown in FIG. 3, the swash plate 14 is twisted around an axis perpendicular to the central axis of the drive shaft 6 in such a manner that the right side of the swash plate 14 is displaced downward, and the left side thereof is displaced upward as shown in dotted lines in FIG. 3.

Figure 5:
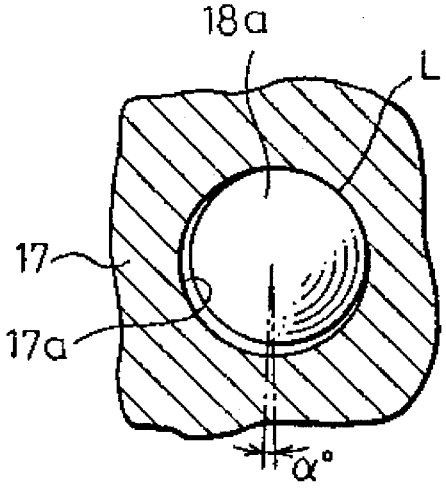
FIG. 5 is a sectional view of the primary portion of the circular hole (guide surface) and the spherical portion of the guide pin of the compressor of FIG. 1.

At this time, as shown by the mark "L" in FIG. 5, the spherical element 18*a* of each guide pin 18 is in contact with the circular guide holes (guide surfaces) 17*a* in a line contact condition, so that the suction and compression-reaction forces acting on the swash plate 14 and the torque provided for the swash plate 14 are supported on the above-mentioned contact line L. Accordingly, during the high speed operation of the compressor and the high compression ratio operation of the compressor, the hinge unit "K" for pivotally supporting the rotary swash plate 14 can be surely prevented from being abnormally worn away. Therefore, the durability of the compressor can be enhanced.

In the above-described compressor, since the circular guide holes (guide surfaces) 17*a*, 17*a* of the pair of support arms 17, 17 extends in such a manner that the circular section of each circular guide hole 17*a* crosses with a plane along which the rotation of the rotor 16 occurs, the torque transmitted from the drive shaft 6 to the rotor 16 can be easily transmitted to the spherical elements 18*a*, 18*a*.

Further, during the operation of the compressor at various capacities, the direction of the center line "S" of the circular guide holes (guide surfaces) 17*a*, 17*a* is set so as not to cause any appreciable change in the top dead center of each piston 10, irrespective of a change in the inclination angle of the rotary swash plate 14. Thus, the back and forth nutating motion of the rotary swash plate 14 is appropriately restricted by the hinge unit "K", and as shown by the curve $G_1$ in FIG. 6, the top clearance of the piston 10 at the top dead center thereof in the cylinder bore 9 becomes so small that it can be ignored from the viewpoint of the performance of the compressor.

Figure 6:
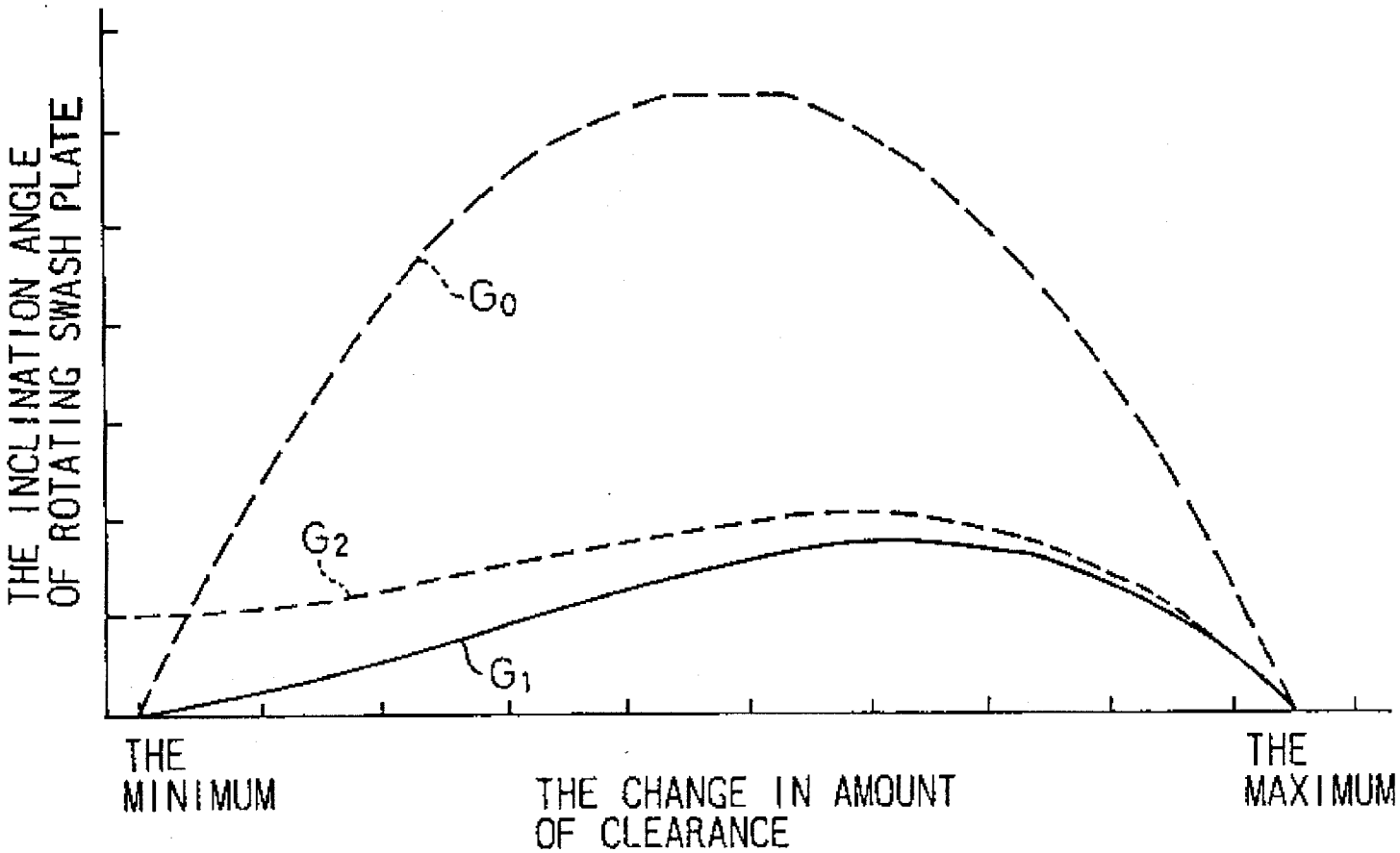
FIG. 6 is a graph illustrating a relation between the inclination angle of the rotary swash plate and a change in top clearance of the compressor of FIG. 1.

The graph in FIG. 6 also indicates the relationship between the inclination angle of the rotary swash plate and the top clearance is shown with the compressor disclosed in the pending Unexamined Japanese Patent Application (Kokai) No. 4-295185 published on Oct. 20, 1992. The relation of the compressor of JP-A-4-295185 is indicated by a curve "$G_0$". When a comparison is made between the curves "Go" and "$G_1$" in FIG. 6, It will be understood that although the circular guide holes (guide surfaces). 17*a*, 17*a* of the compressor of FIGS. 1 through 5 are formed as a linear through-hole, respectively, which can be easily bored in the manufacturing process of the compressor, the compression efficiency of the compressor is very high.

With the circular guide holes (guide surfaces) 17*a*, 17*a* of the hinge unit "K" accommodated in the compressor of FIGS. 1 and 2, which has the characteristic curve "$G_1$" shown in FIG. 6, each piston 10 may mechanically interfere with the valve plate 4 due to manufacturing and assembling error of the hinge unit "k" and the pistons 10 in order to avoid the mechanical interference, it is necessary to check not only the amount of top clearance at the time the compressor performs the maximum capacity operation but also the amount of top clearance at the time the compressor performs the minimum capacity operation. When the top clearance at the time of the maximum capacity operation is larger than that at the time of the minimum capacity operation, the interference between the piston 10 and the valve plate 4 can be avoided. Nevertheless, according to this method, the compressor must exhibit a large performance in order to achieve the maximum capacity operation. Therefore, another embodiment of the present invention has been proposed so as to overcome the above-mentioned problem. That is, the circular guide holes (guide surfaces) 17*a*, 17*a* are arranged in such a manner that the top clearance at the time of the minimum capacity operation is larger than that at the time of the maximum capacity as shown by the characteristic curve $G_2$ in FIG. 6. According to this arrangement of the circular guide holes 17*a*, 17*a*, in the case where the interference between the piston 10 and the valve plate 4 should be avoided, labor to check the top clearance at various capacity operations can be saved if only the top clearance between the pistons 10 and the valve plate 4 at the time of the maximum capacity operation of the compressor is checked, and the reduction of the compression performance of the compressor can be avoided.

Figure 7:
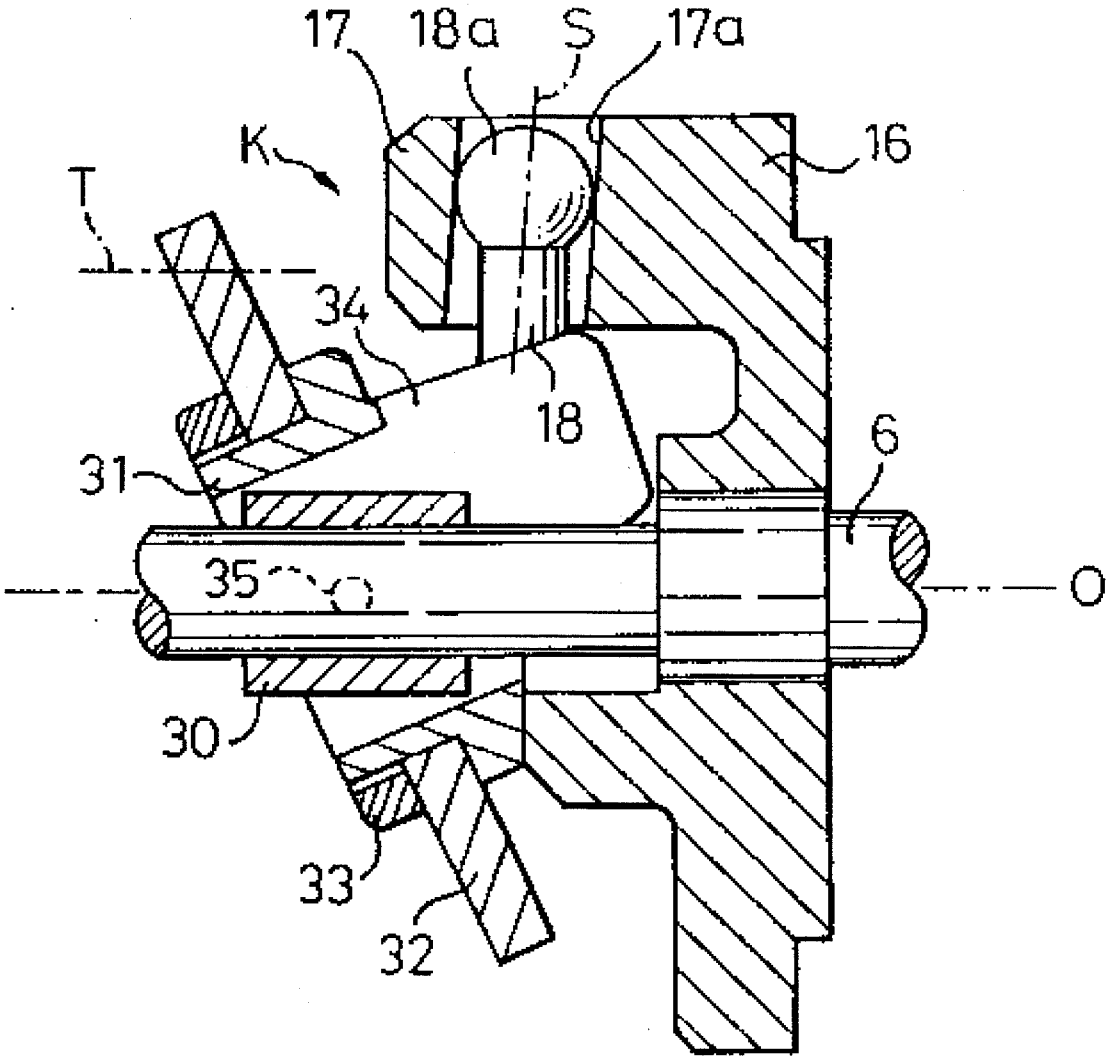
FIG. 7 is a sectional view illustrating the primary portion of a variable capacity swash plate type compressor according to another embodiment of the present invention, illustrating the maximum capacity position thereof.
Figure 8:
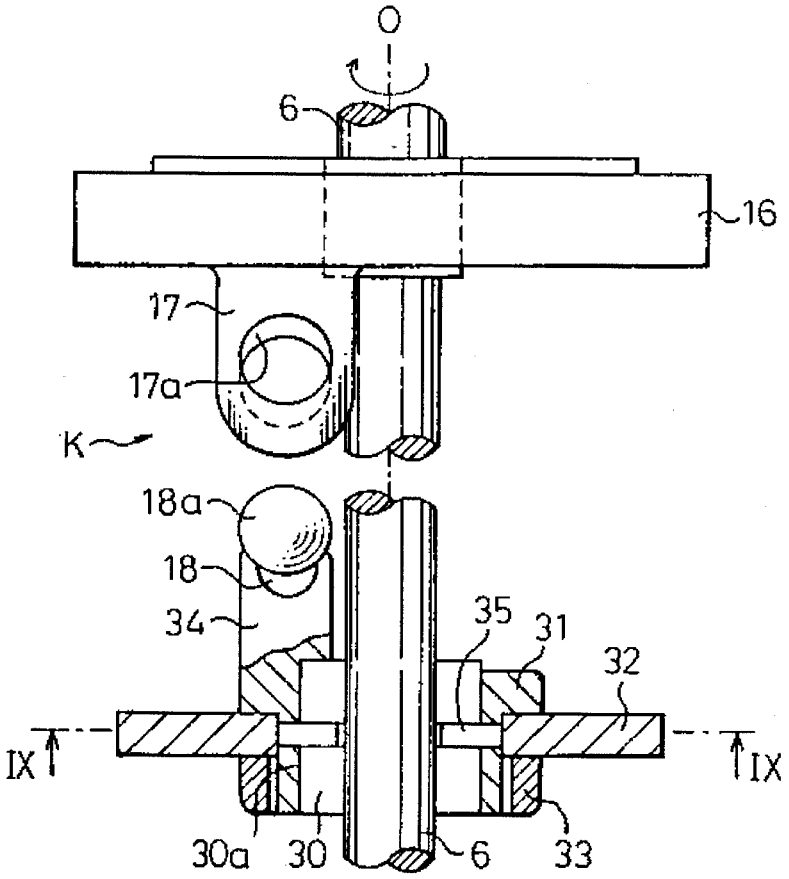
FIG. 8 is a partially sectional exploded plan view, illustrating a hinge unit of the compressor of FIG. 7.
Figure 9:
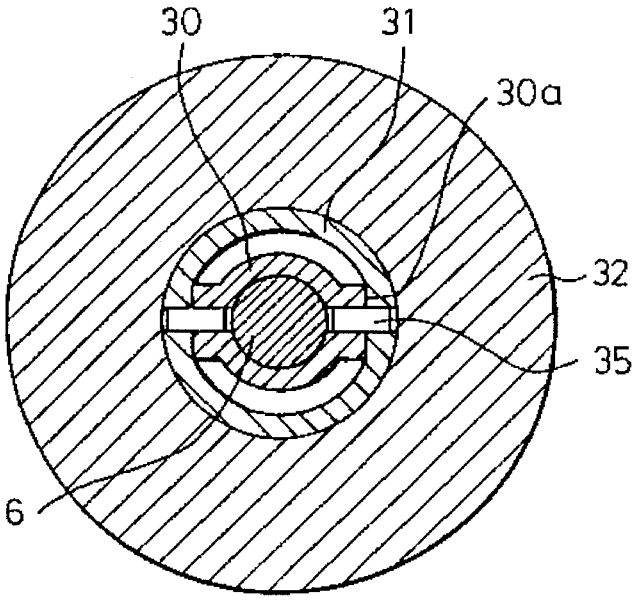
FIG. 9 is a sectional view taken along the line IX—IX of FIG. 8, illustrating the swash plate and spherical sleeve of the compressor of FIG. 8.

FIGS. 7 through 9 illustrate a variable capacity swash plate type compressor according to a different embodiment (a second embodiment) of the present invention. In the embodiment of FIGS. 7 through 9, a cylindrical sleeve is adopted instead of the described spherical sleeve, and the shape and construction of a rotary swash plate is modified from that of the afore-mentioned embodiment so as to be coordinated with the cylindrical sleeve.

As illustrated in FIG. 7, the compressor includes a cylindrical sleeve 30 slidably mounted around the drive shaft 6. As illustrated in FIGS. 8 and 9, flat surfaces 30*a* formed at both ends of the cylindrical sleeve 30 are in contact with the inner surface of a swash plate support body 31. The swash plate support body 31 and the cylindrical sleeve 30 are connected together by trunnion pins 35 fixed to both flat surfaces 30*a*. Therefore, the swash plate support body 31 is pivotally supported by the trunnion pins 35. Namely, the swash plate support 31 can pivot about the outer circumferential surface of the pin 35.

A rotary swash plate 32 is fixed to the swash plate support body 31 with a screw member 33. On the back side of the swash plate support body 31, a single bracket 34 composing a part of the hinge unit "K" protrudes at a position shifted toward the preceding side (the left side of FIG. 8) with respect to the direction of rotation of the drive shaft 6 from the top dead center "T" of the rotary swash plate 32. One end of a guide pin 18 which is similar to that of the previous embodiment is fixed to the bracket 34, and the other end of the guide pin 18 is fixed to the spherical element 18*a*.

A single support arm 17 composing the remaining part of the hinge unit "K" protrudes backward in the axial direction from the upper front surface of the same rotor 16 as that of the previous embodiment in such a manner that the support arm 17 is opposed to the guide pin 18. The constructions of other portions of the compressor are the same as those of the previous embodiment. Further, like parts of the compressor of FIGS. 7 through 9 are identified by the same reference numerals, and the detailed explanations thereof are omitted here.

When the pressure level in the crank chamber 5 is lowered in the compressor constructed in the manner described above, the rotary swash plate 32 nutates backward about the pins 35, and the cylindrical sleeve 30 slides on the drive shaft 6 in a forward direction against a spring force of the pushing spring 13. Therefore, the inclination angle of the rotary swash plate 32 is increased, and accordingly, the discharge capacity of the compressor is increased.

On the contrary, when the pressure level in the crank chamber 5 is increased, the rotary swash plate 32 nutates forward on the cylindrical sleeve 30, and at the same time, the cylindrical sleeve 30 yields to the force of the pushing spring 13. Therefore, the inclination angle of the rotary swash plate 32 is reduced, and the discharge capacity of the compressor is decreased.

During the operation of the compressor, the rotary swash plate 32 tends to be kept away from the rotor 16 on the trailing thereof side with respect to the rotational direction, i.e., in the right half portion thereof in FIG. 8, but the rotary swash plate 32 is pressed against the rotor 16 on the preceding side thereof with respect to the rotational direction, i.e., in the left half portion thereof in FIG. 8. Namely, during the operation of the compressor, the suction and compression-reaction forces acts so as to twist the rotary swash plate 32 about an axis perpendicular to the central axis "O" of the drive shaft 6. Nevertheless, such twisting of the rotary swash plate 32 can be prevented. This is because the swash plate 32 is sustained by the flat surfaces 30*a* of the cylindrical sleeve 30.

It is, however, required that the rotary swash plate 32 of the compressor is supported in such a manner that it can smoothly nutate back and forth during the rotation thereof with the drive shaft 6. Thus, a small gap is always left between the rotary swash plate 32 and the flat surfaces 30*a* of the cylindrical sleeve 30. A small gap is also left between the circular guide hole (guide surface) 17*a* and the spherical portion 18*a* of the guide pin 18. For this reason, the rotary swash plate 14 is slightly twisted around an axis perpendicular to the axis "O" of the drive shaft 6 with respect to the rotor 16. For example, the rotary swash plate 14 is twisted by a small angle (not shown). Thus, in FIG. 8, the right side of the swash plate 32 is tilted downward with respect to the rotor 16, and the left side thereof is tilted upward.

At this time, in the compressor of FIGS. 7 through 9, the spherical portion 18*a* of the guide pin 18 comes into contact with the circular guide hole (guide surface) 17*a* in a line contact condition. Therefore, abnormal abrasion of the hinge unit "K" does not occur similarly to the case of the previous embodiment of FIGS. 1 through 6.

Figure 10A:
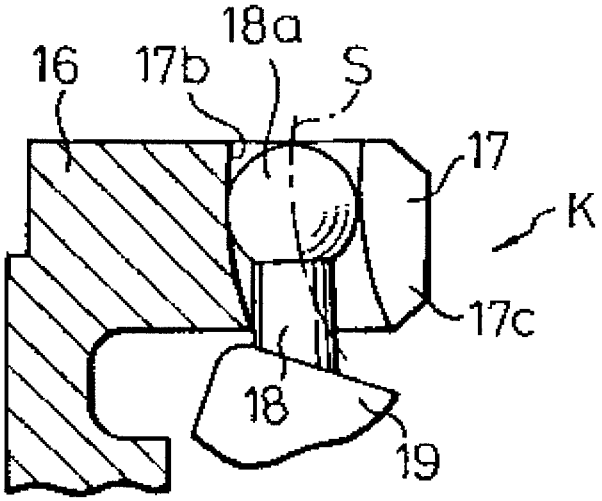
FIG. 10A is a sectional view of the primary portion of an hinge unit incorporated in a variable capacity swash plate compressor according to a still further embodiment of the present invention.
Figure 10B:
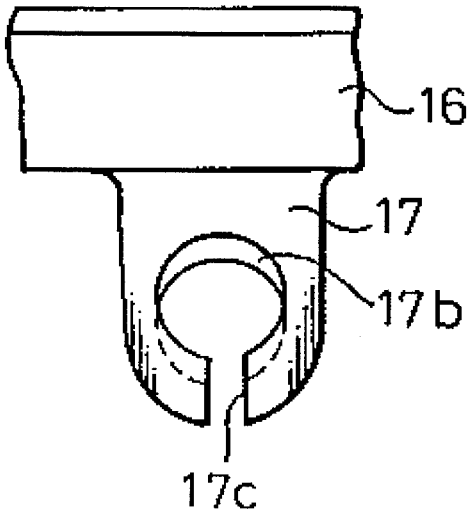
FIG. 10B is a plan view illustrating a circular hole (guide surface) provided in the rotor of the compressor.

FIGS. 10A and 10B illustrate a variable capacity swash plate type compressor according to a third embodiment of the present invention. In the compressor of the third embodiment, a pair of hinge units "K" are provided for pivotally supporting the swash plate (only one hinge unit "K" is shown). In FIGS. 10A and 10B, it is illustrated that each of the pair of support arms 17 is provided with a circular guide hole (guide surface) 17*b* formed therein so as to guide the spherical element 18*a*, and the center line "S" of the guide surface 17*b* is curved so as to have a predetermined radius of curvature so that the top dead center of the piston 10 can be always maintained at a minimum irrespective of the inclination angle of the swash plate 14. In this connection, from the viewpoint of machining work, the circular guide hole (guide surface) 17*b* has an opening 17*c* on the rear side. Constructions of other portions of the compressor are substantially the same as the compressor of FIGS. 1 and 2, and therefore, like elements and parts are identified by the same reference numerals, and the explanation thereof are omitted here.

In the compressor, the circular guide hole (guide surface) 17*b* of each support arm 17 of the rotor 16 guides the nutating motion of the rotary swash plate 14 during the rotation thereof with the drive shaft 6, the top clearance of the piston 10 becomes approximately zero at the top dead center. Accordingly, the compression efficiency of the compressor can be high irrespective of a change in the discharge capacity thereof.

Figure 11A:
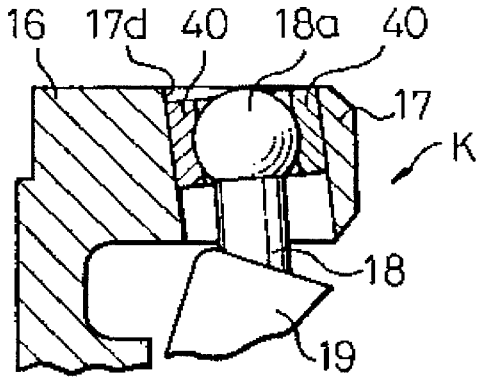
FIG. 11A is a sectional view illustrating the primary portion of the hinge unit of a variable capacity swash plate compressor according to a still further embodiment of the present invention.
Figure 11B:
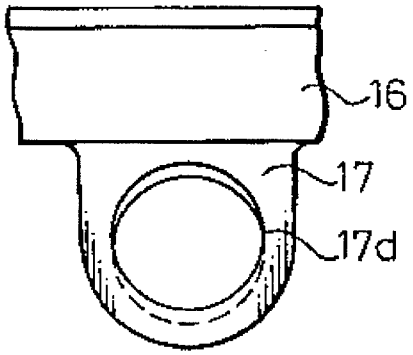
FIG. 11B is a plan view illustrating the circular guide hole (guide surface) provided in the rotor of the compressor of FIG. 11A.
Figure 11C:
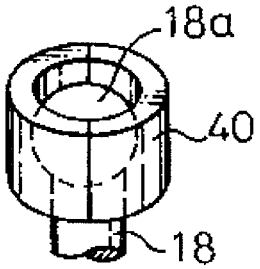
FIG. 11C is a perspective view, illustrating the guide pin and shoe of the compressor of FIG. 11A.

FIGS. 11A through 11C illustrate a variable capacity swash plate type compressor according to a fourth embodiment.

The compressor of FIGS. 11A through 11 has a construction thereof similar to those shown in FIGS. 1 and 2 except for provision of shoes 40, 40 for the hinge units "K". The shoes 40, 40 are rotatably held by the spherical elements 18*a*, 18*a* of the guide pins 18, 18. The shoes 40, 40 are slidably fitted in the circular guide holes (guide surfaces) 17*d*, 17*d* of the support arms 17, 17. The constructions of other portions of the compressor are the same as those of the compressor of FIGS. 1 and 2, and therefore, like elements and parts are identified by the same reference numerals, and the explanations thereof are omitted here.

For example, in the compressor of FIGS. 11A through 11C, even when the rotary swash plate 14 is twisted around an axis perpendicular to the axis of the drive shaft 6 with respect to the rotor 16, the spherical portion 18*a* of the guide pin 18 comes into contact with the shoes 40, 40 in a surface contact condition, so that the shoes 40, 40 also come into contact with the circular guide holes (guide surface) 17*d*, 17*d* in a surface contact condition. Thus, in the compressor of FIGS. 11A through 11C, the hinge units "K" are not abnormally abraded and, accordingly, the durability of the compressor can be highly improved.

Figure 12A:
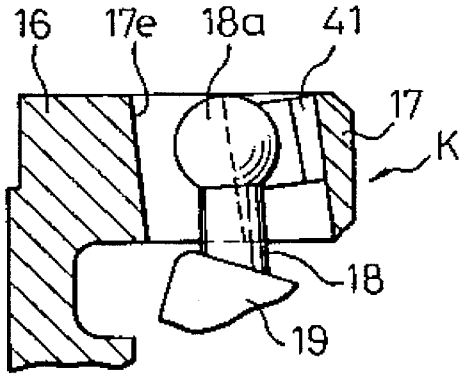
FIG. 12A is a sectional view of the primary portion of a hinge unit of a variable capacity swash plate type compressor according to a further embodiment of the present invention.
Figure 12B:
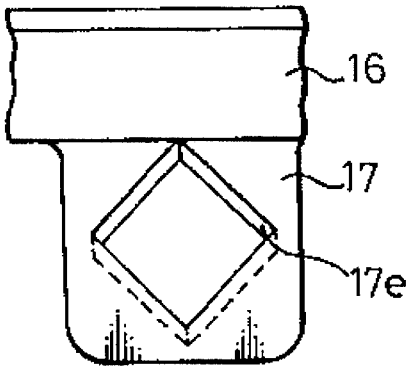
FIG. 12B is a plan view of the hinge unit, illustrating the square guide hole (guide surface) formed in the rotor of the compressor of FIG. 12A.
Figure 12C:
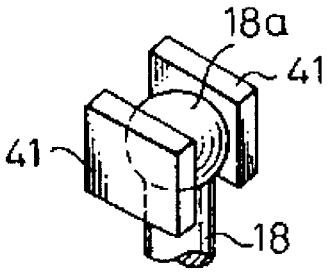
FIG. 12C is a perspective view showing the guide pin and shoe of the compressor of FIG. 12A.

FIGS. 12A through 12C illustrate a fifth embodiment of the present invention.

As illustrated in FIGS. 12A through 12C, in the compressor, a pair of shoes 41,41 (only one is shown) are rotatably held by the spherical portions 18*a*, 18*a* of the guide pins 18. The shoes 41, 41 are slidably fitted in the square guide holes (guide surface) 17*e*, 17*e* of the support arms 17, 17 of the rotor 16. Constructions of other portions are the same as those of the first embodiment of FIGS. 1 and 2, and like elements and parts are identified by the same reference numerals, and the explanations thereof are omitted here.

For example, in the compressor, even when the rotary swash plate 14 is twisted around an axis perpendicular to the axis "O" of the drive shaft 6 with respect to the rotor 16, the spherical elements 18*a*, 18*a* of the guide pins 18 come into contact with the shoes 41, 41 in a surface contact condition, so that the shoes 41, 41 also come into contact with the square guide holes (guide surface) 17*e* in a surface contact condition. Accordingly, in this compressor, the hinge units "K" are not abnormally worn away, and the durability of the compressor can be sufficiently high.

Figure 13A:
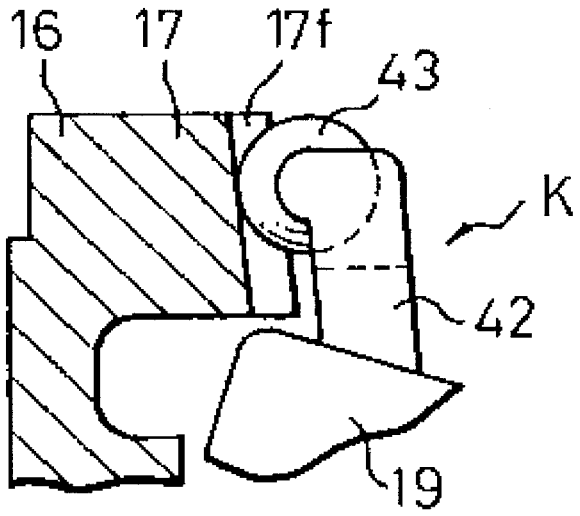
FIG. 13A is a sectional view of the primary portion of a hinge unit of a variable capacity swash plate type compressor according to a still further embodiment of the present invention.
Figure 13B:
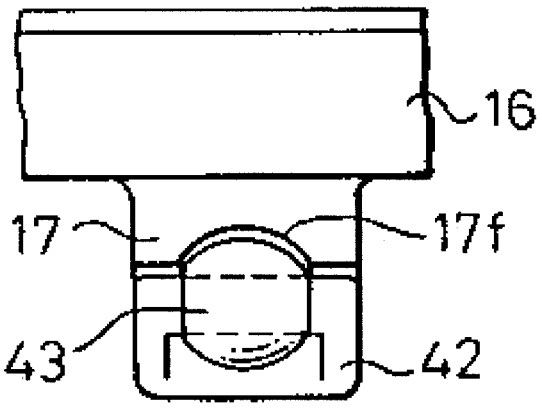
FIG. 13B is a plan view of the hinge unit of FIG. 13A.
Figure 14:
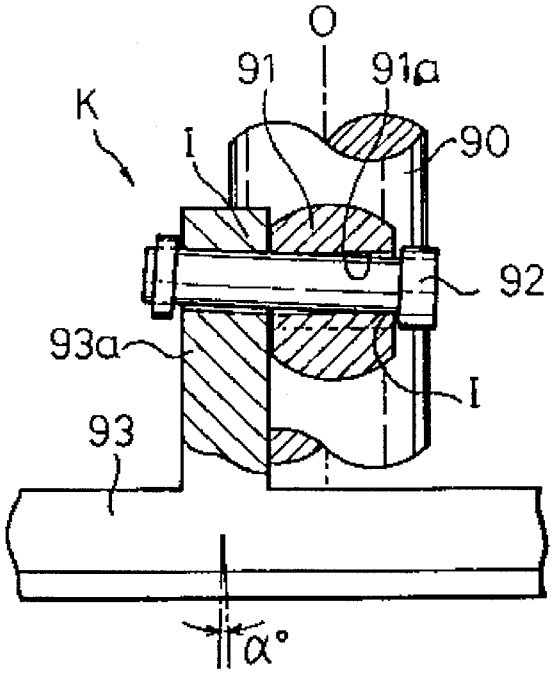
Fig.14 (PRIOR ART)
FIG. 14 is a sectional view of the primary portion of a hinge unit provided for a variable capacity swash plate type compressor according to a prior art.
Figure 15:
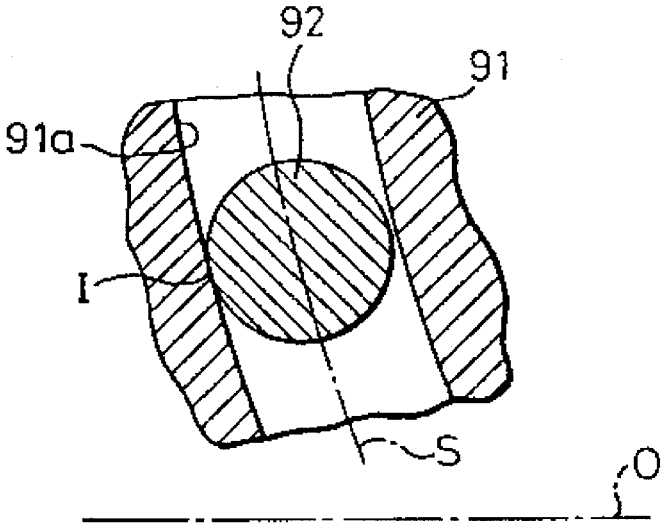
Fig.15 (PRIOR ART)
FIG. 15 is an enlarged sectional view of the primary portion of the hinge unit of the conventional compressor of FIG. 14.

FIGS. 13A and 13B illustrate a variable capacity swash plate type compressor of a sixth embodiment of the present invention.

As illustrated in FIGS. 13A and 13B, in the compressor, a guide surface of the hinge unit "K" is composed of a cylindrical recess-like groove 17*f* formed in the rotor 16, and the rotatable spherical element 43 capable of rolling in the cylindrical groove (guide surface) 17*f* is pivotally supported by an end portion of the guide pin 42 of a bracket 19 of the swash plate 14 (not shown).

For example, in the compressor of this embodiment, even when the rotary swash plate 14 is twisted around an axis perpendicular to the axis "O" of the drive shaft 6 (not shown in FIGS. 13A and 13B) with respect to the rotor 16, the spherical element 43 can be in contact with the cylindrical guide groove (guide surface) 17*f* in a line contact condition. Therefore, the compressor of the sixth embodiment can exhibit the same advantageous effect as that exhibited by the first embodiment illustrated in FIGS. 1 and 2.

Further, in tile compressor of the sixth embodiment, the spherical element 43 rolls in the cylindrical guide groove (guide surface) 17*f*, and accordingly, the spherical element 43 is always guided by the guide groove 17*f* under a low frictional condition. Accordingly, the discharge capacity of the compressor can be smoothly changed.

Throughout the described embodiments, the shoes 15, 15 used for connecting between the swash plate and respective pistons 10 may be replaced with piston rods arranged between a swash plate 14 and respective pistons 10.

in the compressors of the above embodiments, the rotary swash plate 14 is rotated synchronously with the rotation of the drive shaft 6. However, the present invention may be applied to a variable capacity compressor in which a combination of swash and wobble plates is employed, From the foregoing description, it will be understood that the compressor of the present invention employing an improved hinge unit or units "K" can exhibit many advantageous effects as set forth below.

(1) Even when the swash plate is twisted around an axis perpendicular to the central axis of the drive shaft with respect to the rotor, the spherical element of each guide pin is in line contact with the guide surface of the support arms of the hinge unit "K". Therefore, the hinge unit is not abnormally worn away. Consequently, the compressor can show a long operational durability.

(2) The hinge unit "K" of the compressor according to the present invention is provided with an easily manufactured construction, and therefore, the manufacture of the compressor can be also easy.

(3) The compressor according to the present invention can smoothly change the discharge capacity thereof in addition to the above-mentioned advantageous effects.

(4) The compressor according to the present invention performs in such a manner that even when the swash plate is twisted with respect to the rotor, the spherical element of the hinge unit is always in surface contact with the cylindrical shoe of the hinge unit, and also the cylindrical shoe is always in surface contact with the guide surface of the hinge unit. Therefore, the hinge unit is seldom subjected to abnormal abrasion. Consequently, this compressor exhibits excellent durability.

(5) In the compressor according to the present invention, the suction and compression-reaction forces of the piston can be appropriately supported by the hinge unit. Therefore, the swash plate can be prevented from being twisted with respect to the rotor. Accordingly, the compressor exhibits an excellent durability.

(6) The compressor according to the present invention can be constructed in such a manner that the top clearance of the pistons can be set to approximately zero at the top dead center, so that the compression efficiency of the compressor can be appreciably high.

We claim:

1. A variable capacity swash plate type compressor comprising:

a housing means in which a crank chamber, suction chamber, discharge chamber, and a plurality of cylinder bores fluidly connected with said chambers are formed;

pistons arranged in each of said cylinder bores, said piston being capable of reciprocating in each of said plurality of cylinder bores;

a drive shaft rotatably supported by said housing;

a rotor arranged in said crank chamber, said rotor being mounted on said drive shaft so as to rotate together with said drive shaft;

a swash plate operably connected with said rotor via a hinge means, said swash plate being also connected with said drive shaft to thereby be able to change an inclination angle thereof; and, a connection means arranged between said swash plate and pistons, said connection means converting a nutating motion of said swash plate into a reciprocating motion of said pistons, whereby the inclination angle of said swash plate is controlled by a pressure in said crank chamber to thereby change a discharge capacity of said compressor;

wherein said hinge means comprises:

at least one support arm protruding backward from said rotor; and, a guide pin having one end thereof fixed onto said swash plate, wherein said support arm has a guide surface arranged so as to extend in a direction in which said guide surface approaches the central axis of said drive shaft from an outer edge of said support arm, said guide surface being formed in such a manner that at least a front part of a section of said guide surface, taken perpendicularly to a center line of said guide surface, is formed in a circular arc, and the other end of said guide pin being provided with a spherical element engaged with said guide surface.

2. A variable capacity swash plate type compressor according to claim 1, wherein said guide surface of said support arm is defined by a wall surface of a circular hole formed in said support arm, and wherein said spherical element is fixed to said other end of said guide pin, and is rotatably and slidably in contact with and guided by said guide surface of said support arm.

3. A variable capacity swash plate type compressor according to claim 1, wherein said spherical element is held by said other end of said guide pin so as to be free to rotate, and said spherical element being fitted in said guide surface so as to roll on said guide surface.

4. A variable capacity swash plate type compressor according to claim 1, wherein said hinge means comprises a pair of hinge units arranged on both sides of said top dead center of said swash plate.

5. A variable capacity swash plate type compressor according to claim 1, wherein said guide surface has a radius of curvature by which the top dead center position of said pistons are maintained minimum irrespective of the inclination angle of said swash plate.

6. A variable capacity swash plate type compressor comprising:

a housing means in which a crank chamber, suction chamber, discharge chamber, and cylinder bores fluidly communicated with the respective chambers are formed;

pistons arranged in each of said cylinder bores, said pistons being capable of reciprocating in said each of said cylinder bores;

a drive shaft rotatably supported by said housing means;

a rotor arranged in said crank chamber, and supported by said drive shaft in a manner such that said rotor rotates in synchronism with said drive shaft;

a swash plate operably connected with said rotor via a hinge unit, said swash plate being also connected with said drive shaft, whereby an inclination angle of said swash plate is capable of being changed; and, a connection means arranged between said swash plate and said pistons, said connection means converting a nutating motion of said swash plate into a reciprocating motion of said pistons, wherein the inclination angle of said swash plate is controlled by a pressure in said crank chamber so that the discharge capacity is changed, wherein said hinge means comprises:

at least one support arm protruding backward from said rotor; and a guide pin having one end thereof fixed onto said swash plate, wherein said support arm has a guide surface formed therein arranged so as to extend in a direction in which the guide surface approaches the central axis of said drive shaft from an outer edge of said support arm, said guide surface being defined by a wall of a circular hole, the other end of said guide pin being provided with a spherical element, a shoe being rotatably held by said spherical element, and said shoe being slidably fitted in the guide surface of said support arm.

7. A variable capacity swash plate type compressor according to claim 6 wherein said hinge means comprises a pair of hinge units arranged on both sides of said top dead center of said swash plate.

8. A variable capacity swash plate type compressor according to claim 6 wherein said guide surface has a radius of curvature by which the top dead center position of said pistons are maintained minimum irrespective of the inclination angle of said swash plate.

9. A variable capacity swash plate type compressor comprising:

a housing means in which a crank chamber, suction chamber, discharge chamber, and cylinder bores fluidly communicated with the respective chambers are formed;

pistons arranged in each of said cylinder bores, said pistons being capable of reciprocating in said each of said cylinder bores;

a drive shaft rotatably supported by said housing means;

a rotor arranged in said crank chamber, and supported by said drive shaft in a manner such that said rotor rotates in synchronism with said drive shaft;

a swash plate operably connected with said rotor via a hinge unit, said swash plate being also connected with said drive shaft, whereby an inclination angle of said swash plate is capable of being changed; and, a connection means arranged between said swash plate and said pistons, said connection means converting a nutating motion of said swash plate into a reciprocating motion of said pistons, wherein the inclination angle of said swash plate is controlled by a pressure in said crank chamber so that the discharge capacity is changed, wherein said hinge means comprises:

a guide pin having one thereof fixed onto said swash plate, wherein said support arm has a guide surface formed therein arranged so as to extend in a direction in which the guide surface approaches the central axis of said drive shaft from an outer edge of said support arm, said guide surface being defined by a wall of a square hole, the other end of said guide pin being provided with a spherical element, a shoe held by said spherical element, said shoe being slidably fitted inside the guide surface of said support arm.

10. A variable capacity swash plate type compressor according to claim 9 wherein said hinge means comprises a pair of hinge units arranged on both saids of said top dead center of said swash plate.

11. A variable capacity swash plate type compressor according to claim 9 wherein said guide surface has a radius of curvature by which the top dead center position of said pistons are maintained minimum irrespective of the inclination angle of said swash plate.

* * * * *

UNITED STATES PATENT AND TRADEMARK OFFICE

CERTIFICATE OF CORRECTION

PATENT NO. : 5,540,559
DATED : July 30, 1996
INVENTOR(S) : Kazuya Kimura, et al

It is certified that error appears in the above-indentified patent and that said Letters Patent is hereby corrected as shown below:

In Item [73], Change Assignee's Name from "Ube Industries, Ltd., Yamaguchi, Japan" to --KABUSHIKI KAISHA TOYODA JIDOSHOKKI SEISAKUSHO, Kariya, Japan --

Signed and Sealed this
Fifteenth Day of April, 1997

*Attest:*

*Attesting Officer*

BRUCE LEHMAN

*Commissioner of Patents and Trademarks*